US009548015B2

(12) United States Patent
Wu

(10) Patent No.: US 9,548,015 B2
(45) Date of Patent: Jan. 17, 2017

(54) IMAGE COLOR ENHANCEMENT METHOD AND DEVICE FOR DISPLAY

(71) Applicant: Shenzhen China Star Optoelectronics Technology Co., Ltd., Shenzhen, Guangdong (CN)

(72) Inventor: Jinjun Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 111 days.

(21) Appl. No.: 14/399,936

(22) PCT Filed: Oct. 8, 2014

(86) PCT No.: PCT/CN2014/088151

§ 371 (c)(1),
(2) Date: Nov. 7, 2014

(87) PCT Pub. No.: WO2016/045146

PCT Pub. Date: Mar. 31, 2016

(65) Prior Publication Data

US 2016/0093238 A1 Mar. 31, 2016

(30) Foreign Application Priority Data

Sep. 26, 2014 (CN) ..... 2014 1 0505836

(51) Int. Cl.

*G09G 3/20* (2006.01)
*G09G 3/36* (2006.01)
*G09G 5/02* (2006.01)

(52) U.S. Cl.

CPC ..... *G09G 3/2003* (2013.01); *G09G 3/36* (2013.01); *G09G 5/02* (2013.01);
(Continued)

(58) Field of Classification Search

CPC ..... H04N 1/60; H04N 1/6005; H04N 5/52; H04N 9/77; G09G 2320/06; G09G 2320/0666

See application file for complete search history.

(56) References Cited

U.S. PATENT DOCUMENTS 8,288,966 B2 * 10/2012 Medin ..... G09G 3/3413 315/209 R
2004/0246267 A1 * 12/2004 Oohara ..... G09G 5/02 345/591

FOREIGN PATENT DOCUMENTS

CN 1613089 A 5/2005

* cited by examiner

*Primary Examiner* — Antonio A Caschera
(74) *Attorney, Agent, or Firm* — Andrew C. Cheng

(57) ABSTRACT

An image color enhancement method for a display comprises the steps of: gathering tristimulus values of CIE1931 color space in light of all RGB combination of an image shown on the display, and computing a relative chrominance value and a relative luminance value; obtaining a RGB triangle of color gamut of the display according to the chrominance value; for a chromaticity point $D_1$ which is relative to the RGB triangle of a RGB data, defining a relative saturation is $$S1 = \frac{OD_1}{OD};$$

adopting a gain function to conduct gain computing for the relative saturation S1 and obtaining a gain saturation S2; according to a formula $OD_2$=OD*S2, obtaining the gain saturation S2 relative to the chrominance point $D_2$ in the RGB triangle and the chrominance point $D_2$ is located in the line OD; computing the RGB data corresponding to the
(Continued)

chrominance point $D_2$ and obtaining the RGB data after saturation enhancement. An image color enhancement device is for executing the image color enhancement method.

8 Claims, 2 Drawing Sheets

(52) U.S. Cl.
CPC ..... *G09G 2320/0242* (2013.01); *G09G 2320/0666* (2013.01); *G09G 2340/06* (2013.01)

IMAGE COLOR ENHANCEMENT METHOD AND DEVICE FOR DISPLAY

FIELD OF THE INVENTION

The present invention is related to the field of image processing technology, particularly, to an image color enhancement method and device for a display.

BACKGROUND OF THE INVENTION

The liquid crystal display (LCD) which has some advantages of thin body, low power consumption, no radiation and many other advantages is widely applicable, for example, mobile, digital camera, TV screen and so on. The liquid crystal displays in the market nowadays belong to the backlight type liquid crystal displays which comprise liquid crystal display panels and backlight modules. The liquid crystal display panel is disposed in opposite to the backlight module. The backlight module provides the light source for the liquid crystal display for showing the images on the liquid crystal display panels. With the society development, the user requirement of the image quality of the LCD is more and more. In order to enhance the color saturation of the screen, an image color enhancement method is used for image processing and enhancing the visual effect of displaying images.

There are two main image color enhancement methods: the first enhancement method is that the three color components RGB of the image directly processes the same zooming and panning without transferring the color space, then to achieve the hue unchanged; the second enhancement method is that the color space transfers for the color components from the RGB space to the other space, for example HSV space or HSL space, and it transfers back to the RGB space after the corresponding enhancement computing. Comparing with the first enhancement method, the second one can obtain better color enhancement effect. But pertaining to the second enhancement method, the hue is usually changed and results in the color cast while saturation enhancement; or the image has oversaturation which results in distortion when processing the image having higher saturation.

SUMMARY OF THE INVENTION

In view of this, the present invention provides an image color enhancement method and device for a display. The method is to process enhancement computing for image saturation without the color cast problem after color enhancement. Pertaining to the method, the different saturation has the different gain after enhancement computing. The method makes sure that the oversaturated problem will not appear when the original saturation is high.

In order to achieve the aims of the invention mentioned above, the invention uses the following technical solution:

An image color enhancement method for a display, comprising steps of:

S101: gathering tristimulus values of CIE1931 color space in light of all RGB combination of an image shown on the display, and computing a relative chrominance value and a relative luminance value;

S102: obtaining a RGB triangle of color gamut of the display according to the chrominance value;

S103: for a chromaticity point D1 which is relative to the RBG triangle of a RGB data, defining a relative saturation is $$S1 = \frac{OD_1}{OD},$$

wherein O is a relative chrominance point when RGB=(255,255,255), D is an interaction point of OD1 line and the RGB triangle, OD1 is distance between the relative chrominance points O and D1, OD is distance between the relative chrominance points O and D;

S104: adopting a gain function to conduct gain computing for the relative saturation S1 and obtaining a gain saturation S2;

S105: according to a formula OD2=OD*S2, obtaining the gain saturation S2 relative to the chrominance value D2 in the RGB triangle and the chrominance value D2 is located in the line OD;

S106: computing the RGB data corresponding to the chrominance values D2 and obtaining the RGB data after saturation enhancement.

Further, the range of the gain function is from 0 to 1

Further, the gain amount ΔS of the saturation increases first and then decreases when the range of the relative saturation S1 increases from 0 to 1.

Further, the gain function is a sin function according to a formula is $$S_2 = \sin\left(\frac{\pi}{2} * S_1\right).$$

Further, hue and luminance remain unchanged when the gain calculation is conducted for the relative saturation.

On the other hand, the invention is to provide an image color enhancement device for a display. The device comprises:

a data acquisition module, adopting tristimulus values of CIE 1931 color space of an image shown on the display, and computing a relative chrominance value and a relative luminance value, and drawing a RGB triangle of color gamut of the display according to the relative chrominance value;

an initial saturation calculation module, computing a saturating point S1 of a chromaticity point D1;

a gain function generation module, providing a gain function;

a saturation enhancement module, using the gain function to conduct a gain computing for the relative saturation S1 and outputting a gain saturation S2; and a data production module, according to the gain saturation S2, computing and obtaining a RGB data after saturation enhancement.

Further, the process which the initial saturation calculation module calculates the saturating point S1 of the chromaticity point D1, further comprises:

for a chromaticity point D1 relative to the RGB triangle of a RGB data, defining a relative saturation is $$S_1 = \frac{OD_1}{OD},$$

wherein O is a chrominance point when value of RGB=(255,255,255), D is an interaction point of line OD1 and the RGB triangle, OD1 is distance between the relative chrominance points O and D1, OD is distance between the relative chrominance points O and D.

Further, the process which the data production module calculates and obtains the RGB data after saturation enhancement:

according to a formula OD2=OD*S2, obtaining the gain saturation of the relative chrominance point D2 in the RGB triangle and the relative chrominance point D2 is located in the distance OD;

computing the RGB data corresponding to the chrominance values D2 and obtaining the RGB data after saturation enhancement.

Further, the range of the gain function is from 0 to 1.

Further, the gain amount ΔS of the saturation increases first and then decrease when the range of the relative saturation S1 increases from 0 to 1.

Further, the gain function is sin function according to a formula is $$S_2 = \sin\left(\frac{\pi}{2} * S_1\right).$$

Beneficial Effects:

The present invention provides an image color enhancement method and device for display. The method is to process enhancement computing for image saturation without the color cast problem after color enhancement. In the method, the different saturation has the different gain after enhancement calculation. The method makes sure that the supersaturated problem will not appear when the original saturation is high.

DETAILED DESCRIPTION OF THE PREFERRED EMBODIMENTS

In order to elaborate the technical characteristics and the structure of the present invention well, the following examples combining with the accompanying drawings in detail.

First Embodiment

Figure 1:
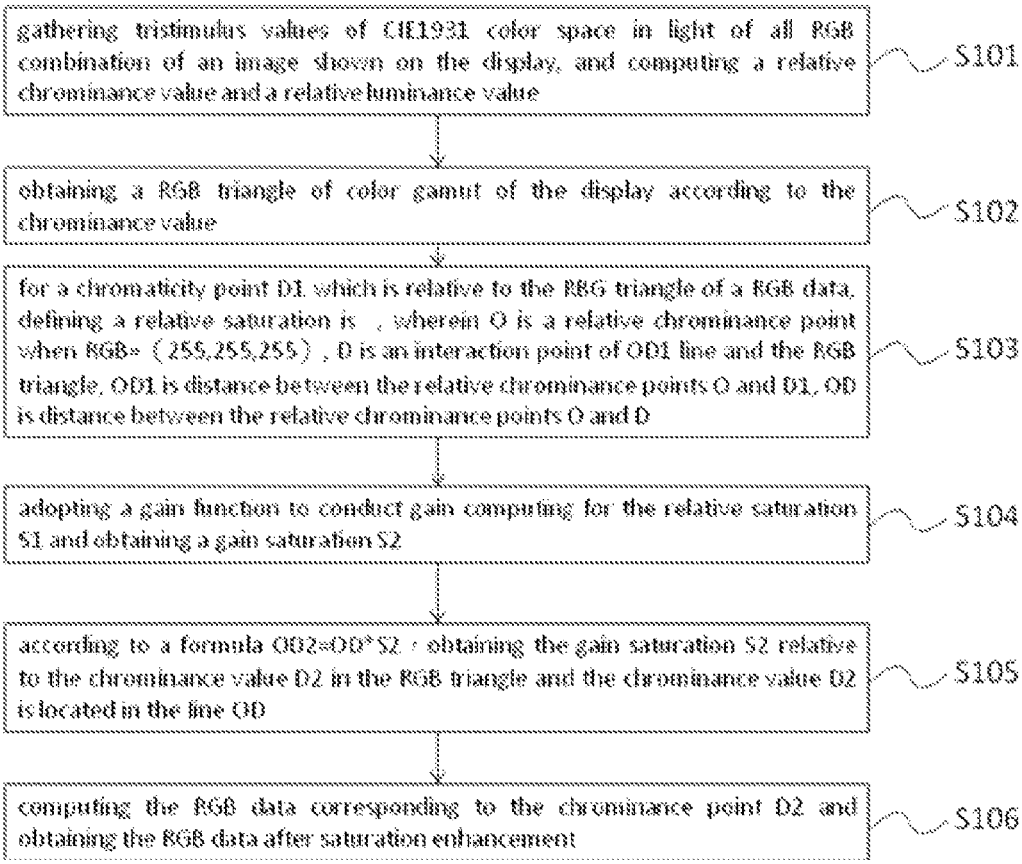
FIG. 1 is the flowchart of the image color enhancement method of the embodiment of the present invention.

The first embodiment provides an image color enhancement method for a display, mainly used in processing LCD image for color enhancement. Please refer to FIG. 1 and FIG. 2. As shown in the flowchart of FIG. 1, the method comprises the step of Step S101, in light of all RGB combination of an image shown on a display, gather the three tristimulus values X, Y, Z of the CIE 1931 color space and computing the relative chrominance value and the relative luminance value, where the all RGB combination means the all combination that R, G, B respectively are from 0 to 255 gray scale.

Step S102, obtain a RGB triangle of the color gamut of the display according to the chrominance value acquired through computing. The RGB triangle of the LCD device of the present invention is shown on FIG. 2, which is the chromaticity diagram of the LCD device.

Step S103, for a chromaticity point D1 which is relative to the RBG triangle of a RGB data, defining a relative saturation is $$S_1 = \frac{OD_1}{OD},$$

wherein O is a relative chrominance point when RGB=(255, 255,255), D is an interaction point of OD1 line and the RGB triangle, OD1 is distance between the relative chrominance points O and D1, OD is distance between the relative chrominance points O and D;

Step S104, adopt a gain function to conduct a gain computing for the relative saturation S1 and obtaining a gain saturation S2;

S105: according to a formula OD2=OD*S2, obtain the gain saturation of the relative chrominance value D2 in the RGB triangle and the relative chrominance value D2 is located in the line OD;

S106: computing the RGB data corresponding to the chrominance point D2 and obtaining the RGB data after saturation enhancement.

Where, in Step S101, a color analyzer could be employed to measuring the three tristimulus values X, Y, Z of the image.

Figure 2:
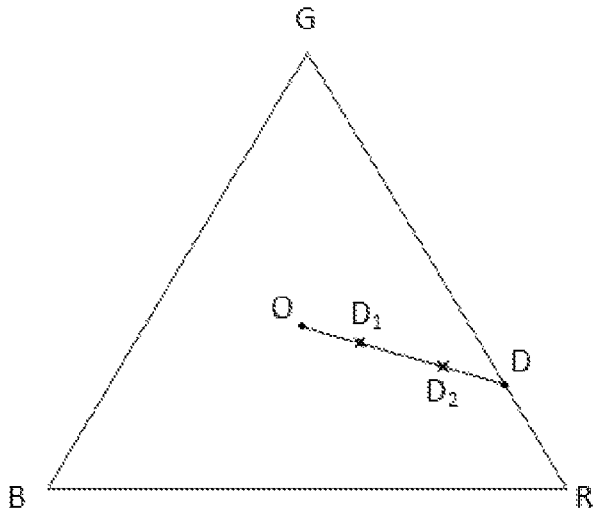
FIG. 2 is the diagram of the RGB triangle of the embodiment of the present invention.

Where, in Step 103, please refer to FIG. 2, the step first defines the relative saturation $$S_1 = \frac{OD_1}{OD},$$

i.e. the largest saturation that the display can show in a certain hue is defined as 1, and the smallest one is 0. Therefore, when enhancing the saturation, the saturation value is only in the range of 0~1. It can avoid increasing the saturation over the range which the display can achieve the saturation value. The value of the gain function can be gathered from 0~1. The value of the saturation is in the range of 0~1 after gain computing.

Further, for the weaker (approaching 0) or the stronger (approaching 1) value of the saturation, if the saturation enhances excessively after processing the gain computing, the issue of image distortion may appear. Therefore, in the present embodiment, the relative saturation S1 for the certain hue is the range from 0 to 1, the gain amount ΔS of the saturation increases first and then decreases after the gain calculation.

In the first embodiment, hue and brightness remain unchanged when the gain computing is conducted for the relative saturation. As shown in FIG. 2, in the RBG triangle, the gain saturation S2 corresponding to D2 is located on the line OD, i.e. the gain saturation S1 corresponding to D1 is located on the same line.

Further, the gain function is selected as the sine function, which the formula is $$S_2 = \sin\left(\frac{\pi}{2} * S_1\right),$$

in the above formula:

when S1=0~1, S2=0~1;

if $$\Delta S = S2 - S1 = \sin\left(\frac{\pi}{2} * S_1\right) - S_1;$$

ΔS can be obtained from the derivative function, $$\Delta S' = \frac{\pi}{2} * \cos\left(\frac{\pi}{2} * S_1\right) - 1$$

When ΔS'=0, $$S_1 = \frac{2}{\pi} * \arccos\left(\frac{2}{\pi}\right) = N,$$

Therefore, when $S_1 \in (0, N)$, ΔS'>0, ΔS progressively increases. When $S_1 \in (N,1)$, ΔS'<0, ΔS progressively decreases.

And, when S1=0 or 1, ΔS=0.

In summary, the gain calculation is processed for the saturation by using the sine function. In the range of S1=0~1, the sine function progressively increases nonlinearly. When the gain amount ΔS≥0 and ΔS increase first and then decrease, i.e. for the weaker (approaching 0) or the stronger (approaching 1) value of the saturation, the saturation increases less after the gain calculation, the gain saturation S2 will be sure to maintain smoothly and the issue of image distortion can be avoided.

Embodiment 2

Figure 3:
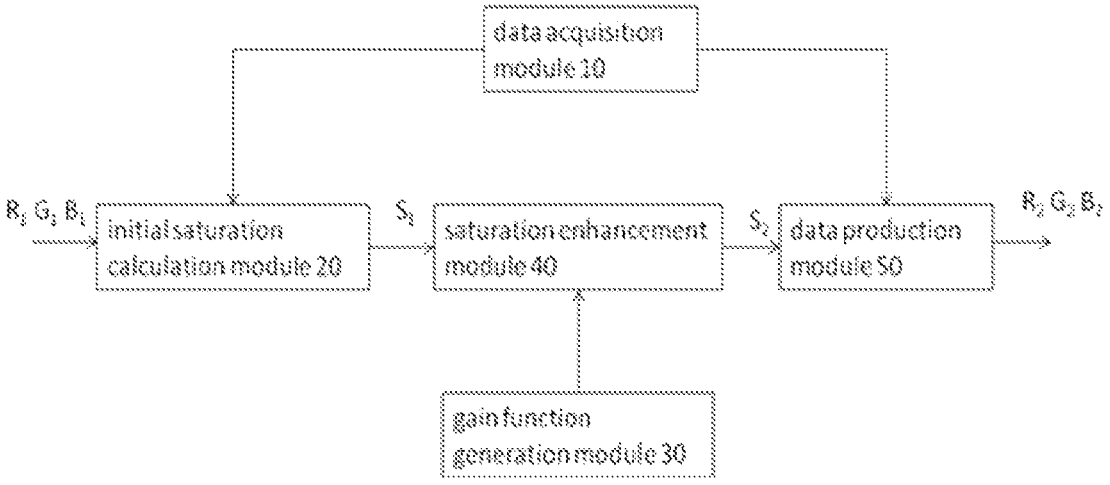
FIG. 3 is the block diagram of the image color enhancement device of the embodiment of the present invention.

The present embodiment provides an image color enhancement device for a display, as shown in the structure of FIG. 3. The device comprises a data acquisition module 10, an initial saturation calculation module 20, a gain function generation module 30, a saturation enhancement module 40 and a data production module 50. The data acquisition module 10 is communicated with, or electrically coupled with, the initial saturation calculation module 20 and the data production module 50. The initial saturation calculation module 20 receives a RGB data (R1, G1, B1), and is further communicated with, or electrically coupled with, the saturation enhancement module 40 to output the relative saturation S1 to the saturation enhancement module 40. The gain function generation module 30 is communicated with, or electrically coupled with, the saturation enhancement module 40 to provide a gain function to the saturation enhancement module 40. The saturation enhancement module 40 further is communicated with, or electrically coupled with, the data production module 50 to provide the gain saturation S2 to the data production module 50. The data production module 50 is communicated with, or electrically coupled with, the display (not shown) to output the RGB data after saturation enhancement (R2, G2, B2) to the display. The display then displays the image according to the RGB data after saturation enhancement.

Please refer to FIG. 3 with FIG. 2 The device is mainly used to carry out each step of the image color enhancement method as the 1st embodiment. The device:

The data acquisition module is mainly used for the all RGB combination in the image shown on the display to gather the tristimulus values of CIE 1931 color space and computing the corresponding chrominance value x, y and the luminance value Y, where, the all RGB combination means the all combination that R, G, B respectively are from 0 to 255 gray scale. Otherwise, the module draws the RGB triangle of color gamut of the display according to the chromaticity values x, y and the RGB triangle inputs into the initial saturation calculation module 20 and the data production module 50. The RGB triangle of the LCD device of the present embodiment is as shown in FIG. 2, such as the chromaticity diagram.

The initial saturation calculation module 20 is used in computing the relative saturation S1 of the color point D1. Specifically, for a chromaticity point D1 relative to the RGB triangle of a RGB data (R1 G1 B1 as shown in FIG. 3) correspondingly, and defining a relative saturation is $$S_1 = \frac{OD_1}{OD},$$

wherein O is a relative chrominance value when RGB=(255, 255,255), D is a interaction point of OD1 line and the RGB triangle, OD1 is distance between the relative chrominance values O and D1, OD is distance between the relative chrominance points O and D. The initial saturation calculation module 20 inputs the relative saturation S1 into the saturation enhancement module 40.

The saturation enhancement module 40 is configured to process the gain computing and obtain the gain saturation S2 according to the relative saturation S1 acquired from the initial saturation calculation module 20 and the gain function S2 received from the gain function generation module 30.

The data production module 50 first receives the gain saturation. According to the formula OD2=OD*S2, defines the chromaticity point D2 in the RGB triangle, where the chromaticity point D2 is located in the line OD; and then computs the chromaticity point corresponding to the RGB data to obtain the RGB data (R2 G2 B2 as shown in FIG. 3) after saturation enhancement.

In summary, the embodiments of the present invention provide the image color enhancement method and device for a display, only for enhancement calculation of the image saturation without any color cast problem after enhancement. Moreover, for different saturation, there are different gain amounts after enhancement computing and the super-saturated problem will not appear when the original image have higher saturation.

It should be noted that, herein, relational terms such as first and second, and the like are only used to distinguish one entity or operation from another entity or action separate, and does not necessarily imply that these entities or the existence of any such relationship or order between actual or operation. Moreover, the terms "comprises," "comprising," or any other variation thereof, are intended to cover a non-exclusive inclusion, such that a series of elements including the process, method, article or device that includes only those elements not expressly listed and further comprising other elements, or further include such process, method, article or device inherent elements. Without more constraints, by the statement "includes one . . . " element defined does not exclude the existence of additional identical elements in the process, including the element, method, article, or apparatus.

Clearly, the scope of the present invention is not limited to the specific embodiments of appeal, the person skilled in the art of the present invention can be various modifications and variations are possible without departing from the spirit and scope of the invention. Thus, if these modifications and variations of the present invention and the claims of the invention are within the scope of technical equivalents, the present invention is also intended to include these changes and modifications included.

What is claimed is:

1. An image color enhancement method for a display, comprising steps of:

gathering tristimulus values of CIE1931 color space in light of all RGB combination of an image shown on the display, and computing a relative chrominance value and a relative luminance value by a data acquisition module;

obtaining a RGB triangle of color gamut of the display according to the chrominance value by the data acquisition module;

for a chromaticity point $D_1$ which is relative to the RGB triangle of a RGB data, defining a relative saturation is $$S1 = \frac{OD_1}{OD}$$

by an initial saturation calculation module, wherein O is a relative chrominance point when RGB=(255,255,255), D is an interaction point of line $OD_1$ and the RGB triangle, $OD_1$ is distance between the relative chrominance points O and $D_1$, line $OD_1$ is a straight line connecting the relative chrominance point O and the chromaticity point $D_1$, OD is distance between the relative chrominance point O and the interaction point D, and line OD is a straight line connecting the relative chrominance point O and the interaction point D;

adopting a gain function to conduct gain computing for the relative saturation S1 by using a gain function generation module;

acquiring the relative saturation S1 from the initial saturation calculation module and the gain function from the gain function generation module by a saturation enhancement module, and obtaining a gain saturation S2 according to the relative saturation S1 and the gain function;

according to a formula $OD_2$=OD*S2, obtaining the gain saturation S2 relative to the chrominance point $D_2$ in the RGB triangle and the chrominance point $D_2$ is located in the line OD;

computing the RGB data corresponding to the chrominance point $D_2$ and obtaining the RGB data after saturation enhancement; and displaying the image on the display according to the RGB data after saturation enhancement.

2. The image color enhancement method as claimed in claim 1, wherein range of the gain function is from 0 to 1.

3. The image color enhancement method as claimed in claim 2, wherein the gain function is a sine function according to a formula is $$S2 = \sin\left(\frac{\pi}{2} * S_1\right).$$

4. The image color enhancement method as claimed in claim 3, wherein hue and illustration remain unchanged when the gain calculation is conducted for the relative saturation.

5. The image color enhancement method as claimed in claim 1, wherein gain amount ΔS of a saturation increases first and then decreases when the range of the relative saturation S1 increases from 0 to 1.

6. The image color enhancement method as claimed in claim 5, wherein the gain function is a sine function according to a formula is $$S2 = \sin\left(\frac{\pi}{2} * S_1\right).$$

7. The image color enhancement method as claimed in claim 6, wherein hue and luminance remain unchanged when the gain calculation is conducted for the relative saturation.

8. The image color enhancement method as claimed in claim 1, wherein the display is a liquid crystal display.

* * * * *